United States Patent [19]

Finkl et al.

[11] Patent Number: 4,950,324

[45] Date of Patent: Aug. 21, 1990

[54] TRI-LEVEL METHOD AND APPARATUS FOR POST MELTING TREATMENT OF MOLTEN STEEL

[75] Inventors: Charles W. Finkl; Bruce Liimatainen, both of Chicago; Herbert S. Philbrick, Jr., Wilmette, all of Ill.

[73] Assignee: A. Finkl & Sons Co., Chicago, Ill.

[21] Appl. No.: 301,170

[22] Filed: Jan. 24, 1989

Related U.S. Application Data

[63] Continuation-in-part of Ser. No. 261,444, Oct. 24, 1988, Pat. No. 4,857,269.

[51] Int. Cl.[5] ..... C21C 5/52

[52] U.S. Cl. ..... 75/10.38; 75/10.39; 75/512; 266/157

[58] Field of Search ..... 75/49, 10.36, 10.39

[56] References Cited

U.S. PATENT DOCUMENTS 4,200,452 4/1980 Savov ..... 75/49

4,780,134 10/1988 Finkl ..... 75/49

*Primary Examiner*—Peter D. Rosenberg

*Attorney, Agent, or Firm*—James G. Staples

[57] ABSTRACT

This invention relates to a new method for the post melting treatment of molten steel in all, or nearly all, of the post melting systems in use at this time to lower the oxygen, hydrogen, and, to some extent, the nitrogen content thereof, and carry out the other purposes for which such systems are used including temperature and chemical homogenization continuous casting, piggy backing and other post melting treatment systems in use at this time in a manner which is less capital intensive, easier to operate and simpler in construction and operation than any of the basic systems, and apparatus therefor.

20 Claims, 5 Drawing Sheets

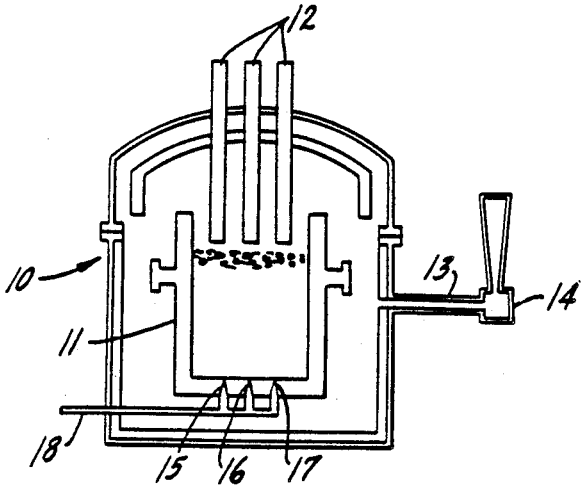
FIG. 1
FIG. 2
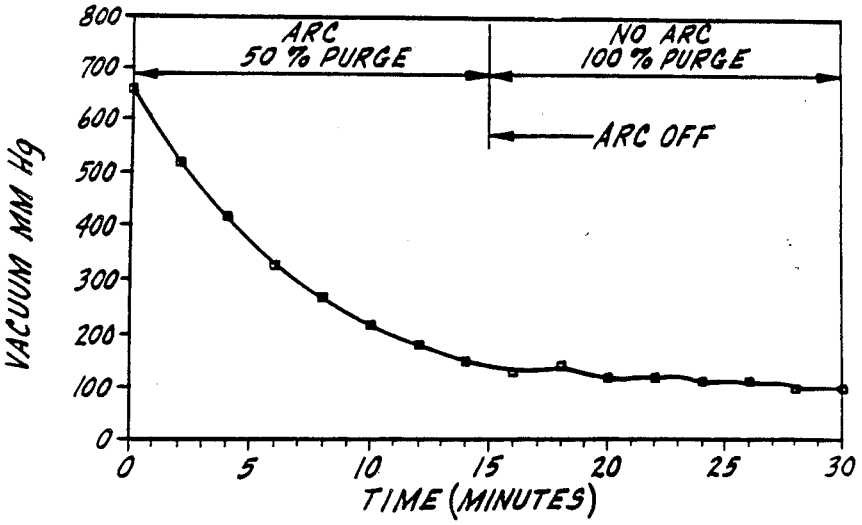
FIG. 7
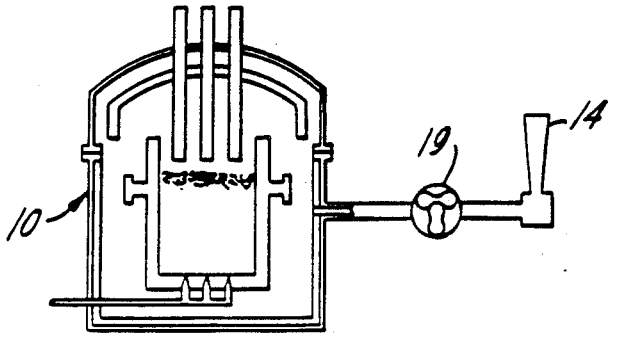

FIG. 5
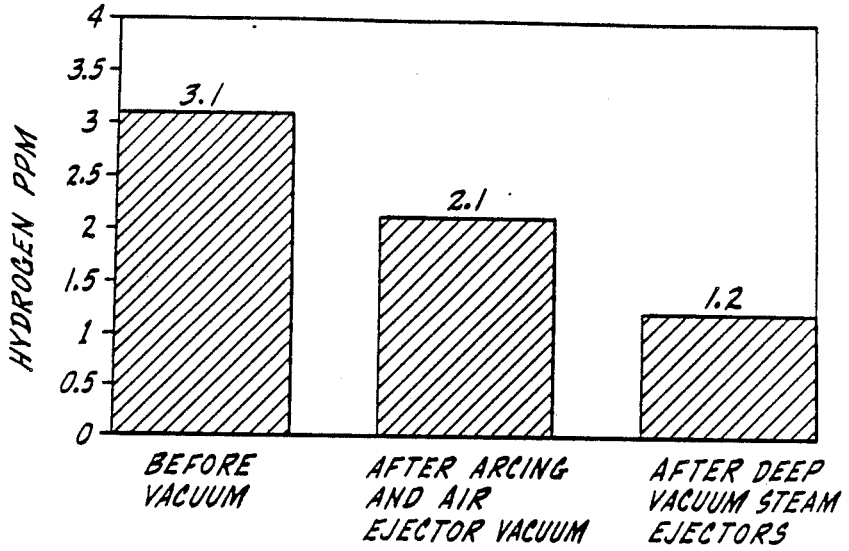
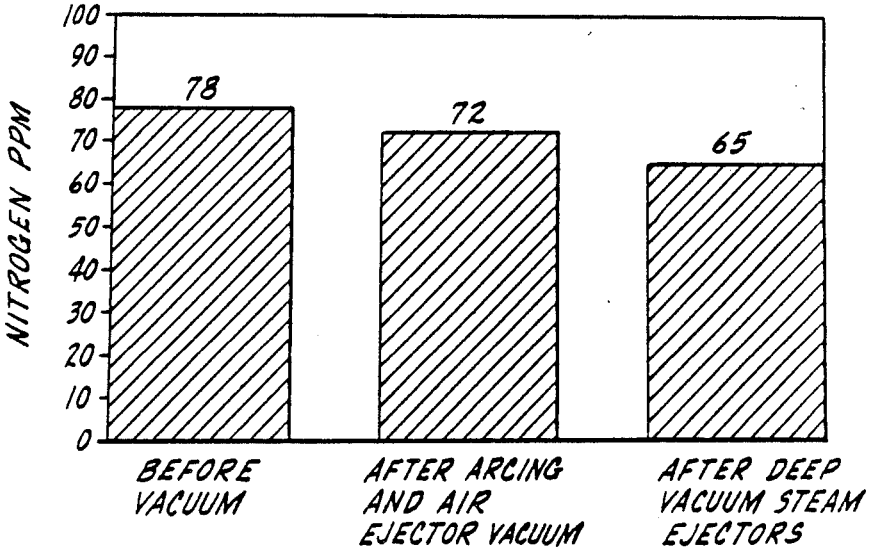
FIG. 6

TRI-LEVEL METHOD AND APPARATUS FOR POST MELTING TREATMENT OF MOLTEN STEEL

This application is a continuation-in-part of application Ser. No. 261,444 filed Oct. 24, 1988, now U.S. Pat. No. 4,857,269.

BACKGROUND OF THE INVENTION

Each of the post melting steel treatment systems in use today is well adapted from a technical standpoint to achieve the results which are demanded of it. However, each system is designed, as it must be, to accommodate the maximum demands which can be envisioned for the system and, as this invention has demonstrated, each such system has inherent deficiencies of a technical or economic nature, or both.

The conventional vacuum arc degassing system enables a user to lower oxygen and hydrogen contents of molten steel to low levels by the use of a sub-atmospheric pressure (or vacuum) which may be as low as less than 1 mm Hg if flake-free hydrogen levels in large sections are desired, an alternating current electric arc which is struck directly between the AC electrodes and the molten steel, and inert gas purging. A typical example can be seen from U.S. Pat. Nos. 3,236,635 and 3,501,289 with respect to which the present invention is, in part, a further development Almost invariably, the vacuum in the U.S. Pat. No. 3,501,289 system, which system is known as the vacuum arc degassing system, is generated by a plurality of steam jet ejectors and it requires, in the U.S. at least, licensed boiler tenders to operate. Also, in the vast majority of commercial installations, the inert gas purging is derived from, preferably, one, or at most, two porous bricks, each of which admits from 3–5 cu. ft./min of purging gas to the molten steel. In some instances a tuyere which produces the same stirring characteristics may be substituted for the purging brick.

Such a system is relatively expensive to build since the steam jet ejector system is relatively expensive Further, such a system is relatively costly to operate due to the cost of generating steam and operators licensing requirements. It has, however, gained wide acceptance due to the ability to achieve the desired low gas results, as well as many other now well recognized advantages over prior systems including temperature and chemical homogenization, contact applications and others.

The ladle furnace is essentially a ladle to which a non-airtight arc furnace cover and electrodes have been added together with a gas purging capacity. The ladle furnace, or LF, is thus capable of heating and purging steel and hence has found application as a holding vessel in a continuous casting system. It is possibly the least expensive of all the post melting systems in that a fully functioning unit may be constructed for only about $250,000. The LF, however, has no vacuum capacity and hence the now universally recognized benefits of vacuum treatment cannot be attained. Its functions are therefore largely limited to temperature and chemical homogenization and holding operations, all of which are useful in continuous casting system.

The DH system utilizes a purging gas in the up leg of an elevated treatment chamber and a high vacuum in the treatment chamber to cause untreated molten steel in a lower, atmospherically exposed source vessel, such as a ladle, to flow upwardly into the treatment chamber where it is subjected to the action of the vacuum before flowing back to the source vessel through a down leg which discharges from the treatment chamber. This system invariably includes a multi-stage steam jet ejector system connected to the treatment chamber to generate the high vacuum therein needed to treat the thin layer of steel flowing from the inlet to the outlet.

Although multi-stage steam jet ejector systems are effective in generating absolute vacuum levels of 1 mm Hg, and even 0.5 mm Hg, they have certain undesirable characteristics. First and foremost is the problem of cleaning. A heat of steel fresh from a melting unit gives off large quantities of dirt and dust when subjected to a vacuum, and this dirt and dust lowers the efficiency of the steam ejector system. Cleaning the ejectors is a disagreeable task which causes the system to be shut down for substantial periods of time at rather frequent intervals—weekly, or even oftener in high production shops.

The following characteristics of steam ejectors may be noted as a background comparison for the advantages attainable with the present invention.

(1) Steam is required for operation. Steam requires a boiler which in turn requires maintenance. The heat energy in the steam is lost, largely, and hence, by comparison as will be apparent hereafter, steam is an expensive motive fluid.

(2) A steam ejector system is a wet system, hence steam condensers are required. Since the steam entrains dust and dirt, a sludge is created which is difficult to handle and dispose of and which plugs ejectors, thereby lowering their efficiency.

(3) A minimum vac of 0.5 mm Hg is attainable, although a more realistically attainable level is 1 mm Hg.

(4) Excellent 0 reduction is attainable, although with special processing such as increased purging rates and/or chemical deoxidation even better 0 reduction is possible.

(5) The lowest possible H reduction of all commercially available systems is attainable.

(6) A purging gas rate of from 3–5 cfm per approximately each 50 short ton increment of heat size is usual.

(7) It is quite expensive to purchase and operate because (a) the steam ejectors are quite costly, (b) the boiler is costly, (c) water treatment systems are costly, (d) steam generation costs are approximately 10 times higher than air used as a motive fluid, (e) sludge handling systems are costly as contrasted to dust handling systems, and (f) a large isolating valve is required.

The combination of a ladle furnace and a ladle degasser, either in the form of two vessels or a single vessel with a vacuum cover which does not contain electrodes and a non-vacuum cover which carries electrodes or other heating means, has also come into use. This system has a relatively high initial cost, particularly as it has been offered by ASEA which includes induction stirring and, of necessity, a stainless steel holding vessel. Again, the vacuum system invariably employed is the steam jet ejector system which has the characteristics mentioned above.

The RH system utilizes a stationary holding vessel and a vertically reciprocable treatment chamber vessel in which a vacuum can be applied. By manipulation of the relative vertical positions of the two vessels and/or variations in the degree of vacuum applied, a portion of the total melt is drawn into the upper treatment vessel where it may be treated by vacuum and then returned to the lower vessel. After a number of cycles, the total melt will have been treated. If a vacuum of 1 mm Hg is applied in the treatment chamber vessel, molten steel in the bottom vessel can be raised up to about 5 feet. Again, this system utilizes a steam jet ejector with the characteristics earlier described.

A recent proposal has been the so-called VAX treatment system. This system, though it does not utilize a steam jet ejector system, is capable of substantial improvement in the post melting phase of steel processing utilizing, in essence, the law of partial pressures to lower the content of undesired gases. This system is described in U.S. Pat. No. 4,655,826 which also discloses the use of arc heating, and to which reference is made for a more complete understanding. It is highly desirable, however, that the art have access to a system which achieves all, or substantially all, of the advantages of the steam jet ejector system when used in applications requiring very low absolute pressures, and arc heating, but at a lower equipment and operating cost, and is simpler to operate. This need is met by the use of an air ejector applied to any one of the conventional treating systems, either as a sole source of sub-atmospheric pressure, or as a supplement to an existing sub-atmospheric pressure

DESCRIPTION OF THE INVENTION

The invention is illustrated more or less diagrammatically in the following drawing wherein:

FIG. 1 is a schematic view of a first embodiment of the system;

FIG. 2 is a graph plotting vacuum level against time in a heat run in a physical embodiment of the system of FIG. 1;

FIG. 5 is a bar graph showing hydrogen removal;

FIG. 6 is a bar graph showing nitrogen removal;

FIG. 7 is a diagrammatic sketch of another embodiment of the invention;

Like reference numerals will refer to like parts from Figure to Figure in the drawing.

Figure 3:
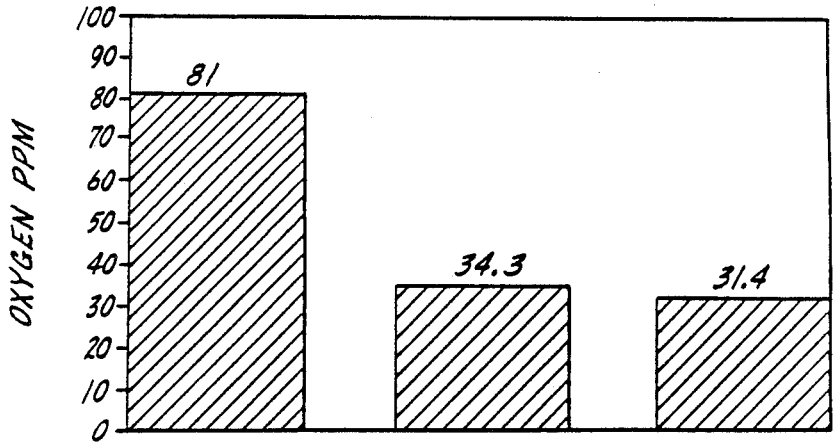
FIG. 3 is a bar graph showing oxygen removal.

The invention of the first embodiment as disclosed in FIGS. 1–6 requires a sealed chamber and sealed electrodes as in a conventional vacuum arc degassing system. However, instead of using a large steam ejector system with barometric condensers, cooling tower, circulating pumps, and hot well, the chamber exhaust connection goes to, for example, one or more small compressed air ejectors and the purging capacity is substantially increased. FIG. 1 shows a schematic of the system.

The system includes a sealed tank, indicated generally at 10, which receives a ladle 11 of molten steel to be treated whereby the space above the metal is sealed at all times from outside ambient atmosphere. It will be understood that this basic structure may take the form of a container for the molten steel which receives a hood; the hood and container together defining the isolated environment above the molten steel. In this instance, three alternating current non-consumable electrodes, such as conventional graphite electrodes, are shown at 12 since the heats described herein were performed on vacuum arc degassing system equipment. It should be understood that if side wall wear of the container, usually a ladle, is a concern, a single electrode may be used. The single electrode current may be single phase AC, three phase were connected AC which results in a rippled current, or DC. The tank exhausts through a pipe 13 which opens into an air ejector 14 which may have the capacity, for example, when treating an approximately 60 metric ton heat of low alloy steel in a chamber of about 1800 cu. ft. capacity of lowering the pressure in the chamber to the beginning of the glow range of the system, such as, purely by way of example, about 100 mg Hg.

It will be understood that a definite vacuum level for the onset of glow cannot be given because glow depends on factors which vary from installation to installation such as vacuum level, voltage, amperage, gas composition in the sealed chamber, electrode temperature, dust in the environment above the molten steel, and others. In the illustrated example, 14" graphite electrodes operating at about 230 volts and 18,000 amps were employed, and glow was observed to begin generally in the 150 mm Hg to 80 mm Hg range.

Three porous purging bricks are indicated at 15, 16, 17 and a source of purging gas, such as argon, is indicated at 18. By suitable valving, the rate of purging gas per plug can be varied from 0 to about 8½ cu. ft./min.

In several trial heats three purge plugs were used in the ladle instead of the normal two plugs which resulted in high purge rates up to a combined total of 25 SCFM. This is approximately five times the normal purge rate used today.

The process takes full advantage of the "dynamic window" under the arcs to enhance gas removal, said window being formed by the power of the arcs which exposes bare metal to the arcs and facilitates the disassociation of alumina into aluminum and oxygen, the oxygen in turn combining with carbon to form CO in accordance with the following equation:

$$Al_2O_3(s)+3C=2\ Al+3CO(g).$$

Oxygen is also removed from the bath as a reaction product of the oxygen in the bath and the carbon in the steel or the electrodes. The heat of disassociation of alumina may be noted from "Thermochemistry of Steelmaking", Elliot and Gleiser, Vol. I, pages 161, 162 and 277, 1960, Addison-Wesley Pub. Co., Reading, Mass.

It will be noted that with high purging rates as described herein plus air ejector means placed in series, a low absolute pressure can be attained, and hence a high degree of hydrogen removal is made possible, all without the equipment and operating expense of steam jet ejectors.

A small diaphragm vacuum pump was connected to the vacuum tank close to the ladle brim to measure an off-gas sample, the pump discharge generating positive pressure and flow to a Horiba Model PIR-2000 CO Analyzer.

The process of the first embodiment consists essentially of a combined use of a heating arc, with an air ejector and a higher purge rate than in a conventional vacuum arc degassing cycle. Medium vacuum levels are attained. A typical cycle is illustrated in FIG. 2.

The heat trial size was normally 60 metric tons. The first 15 minutes were arced using a 50% purge rate which resulted in the admission of a total of 12 SCFM. This arcing period was utilized to enhance oxygen removal and temperature control The second 15 minute portion (no arcing) of the cycle was run at 100% purge rate, 25 SCFM, with the air ejector system pulling down to a deeper vacuum level (around 100 mm) to facilitate hydrogen removal. It will be understood that a larger gas input may be required for a larger container and, correspondingly, a smaller input for a smaller container to achieve the desired results.

For best results, the steel should be tapped from the electric furnace at the lowest practicable hydrogen level. One way to achieve this result is to generate a vigorous CO boil in the electric furnace shortly prior to tap. In addition, care should be taken to ensure that there is minimum moisture in furnace alloy additions and slag reagents.

An average hydrogen level of the molten steel going into the vacuum tank of about 3.2 ppm maximum is attainable and desirable.

A fluid slag is desirable to allow maximum gas removal, especially if low-sulfur chemistry is desired. A di-calcium silicate slag ($Ca_2SiO_4$) with about a 2¼ to 1 lime-silica ratio which has a low melting point —1500° C. (or 2732° F.) may be used to great advantage.

Six trial heats were evaluated representing various compositions. Standard grades AISI 1035 and 4340 were treated as well as specialty die steel and P-20, all as illustrated in Table I.

Sample pins of the molten steel were used for gas analysis. The pins were taken with an evacuated glass tube drawn from a spoon sample which are immediately quenched in ice water. Oxygen and nitrogen were determined on a LECO TC30 special instrument, and hydrogen was determined on an Itac 01 instrument.

The oxygen removal in the air ejector cycle varied from a high of 71% to a low of 39% with 56% average. The average oxygen levels for the air ejector and for comparison, a vacuum arc degassing cycle are shown in FIG. 3.

The results show removal of an average of 47 ppm of oxygen using the air ejectors. An additional 3 ppm of oxygen was removed through the deep vacuum cycle. The greatest oxygen removal with the air ejectors was 75 ppm with the least being 24.5 ppm.

Figure 4:
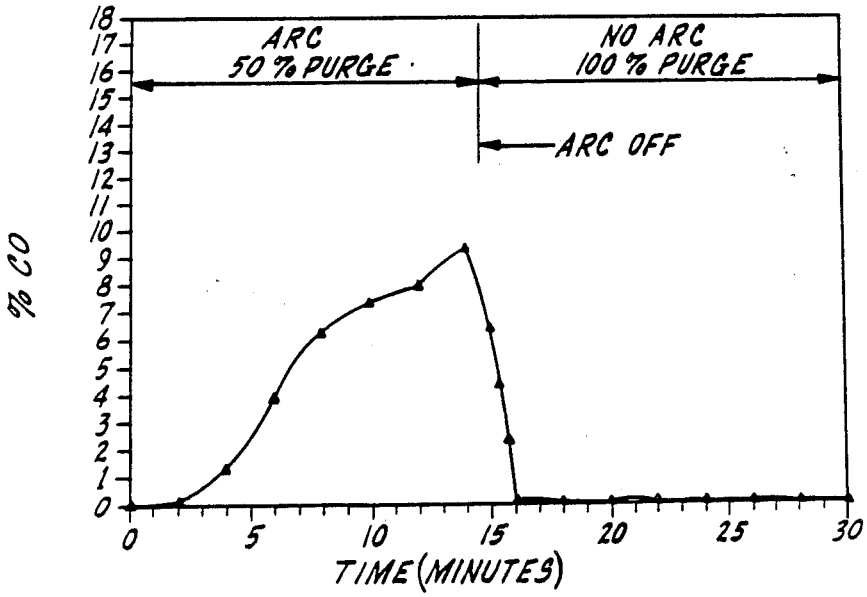
FIG. 4 is a graph plotting CO evolution against time.

The large amount of oxygen removal during the air ejector cycle can be attributed to the combination of the arcs with high purge rate in the beginning of the cycle. Referring to FIG. 4, it will be noted that the CO present in the vacuum chamber goes to a high of 10% while arcing and then decreases rapidly when the arc is extinguished. If flake-free product is not required (i.e.: 2.2 ppm $H_2$ max.), and thus only oxygen was of concern, a shortened cycle of 15 minutes using a high purge rate and heating will accomplish the objective.

The air ejector cycle hydrogen removal varied from a high of 36% to a low of 20% with a 31% average. The average hydrogen levels are shown in FIG. 5.

TABLE I

| | C | Mn | P | S | Si | Ni | Cr | Mo | V | Al |
|---|---|---|---|---|---|---|---|---|---|---|
| FX | .50/.58 | .75/.95 | .010 | .030 | .15/.35 | .85/1.05 | .85/1.15 | .33/.43 | .05 | .015/.025 |
| P20 | .30/.35 | .70/.90 | .010 | .020 | .35/.55 | — | 1.55/1.85 | .40/.50 | — | .015/.025 |

The results obtained utilizing the air ejector system are illustrated in Table II. In this instance, all heats were subsequently subjected to the normal deep vacuum cycle of less than 1 mm Hg since the product specifications required flake-free steel, and thus this extra precaution was deemed prudent in view of the lack of extended experience. Gas analyses after the deep vacuum cycle are included An average of 1 ppm of hydrogen was removed using the air ejectors. If the steel, at the time of tapping from the melting unit, has a sufficiently low hydrogen content, say 3.2 ppm or less, it is possible to reach flake-free hydrogen levels after the air ejector process alone. An additional 0.9 ppm hydrogen was removed through a multi-stage steam ejector deep vacuum cycle. The

TABLE II

| | | | | | | AIR EJECTOR HEATS | | | | | | | | |
|---|---|---|---|---|---|---|---|---|---|---|---|---|---|---|
| Heat # | Grade | H | N | O | | Purge Plugs | Arc Time | Medium Vac Time | Total Time Air Ejector | Best Vac MM | Temp Start °F. | Temp Finish | Total Ft.$^3$ Ar. | Highest Purge Rate Ft.$^3$/Min. |
| 264468 | FX | 2.5 | 82 | 64 | BV | 3 | 8.5 | 21.5 | 30 | 193 | 3040 | 2870 | 750 | 25 |
| | | 2.0 | 72 | 27 | AA | | | | | | | | | |
| | | 1.2 | 63 | 20 | AV | | | | | | | | | |
| 165135 | 1035 | 2.6 | 59 | 63 | BV | 3 | 15 | 15 | 30 | 147 | 2990 | 2920 | 688 | 23 |
| | | 1.9 | 74 | 39 | AA | | | | | | | | | |
| | | 0.9 | 64 | 36 | AV | | | | | | | | | |
| 264685 | 4340 | 3.2 | 66 | 105 | BV | 2 | 17.5 | 12.5 | 30 | 92 | 2975 | 2840 | 284 | 10 |
| | | 2.0 | 64 | 30 | AA | | | | | | | | | |
| | | 1.4 | 61 | 44 | AV | | | | | | | | | |
| 165128 | MD | 3.1 | 101 | 76 | BV | 2 | 11.5 | 20 | 31.5 | 103 | 3035 | 2910 | 443 | 10 |
| | | 2.2 | 89 | 36 | AA | | | | | | | | | |
| | | 1.9 | 81 | 24 | AV | | | | | | | | | |
| 264695 | FX | 4.2 | 81 | 89 | BV | 2 | 15 | 15 | 30 | 100 | 2960 | 2885 | 338 | 11 |
| | | 2.7 | 70 | 35 | AA | | | | | | | | | |
| | | 0.8 | 64 | | AV | | | | | | | | | |
| 165139 | FX | 3.2 | 79 | 89 | BV | 3 | 15 | 30 | 30 | 86 | 2990 | 2930 | 200 | 7 |
| | | 2.1 | 63. | 39 | AA | | | | | | | | | |
| | | 1.2 | 55 | 22 | AV | | | | | | | | | |

BV = Before Arcing and Air Ejector
AA = After Arcing and Air Ejector @ 100 mm Hg Abs.
AV = After Deep Vacuum Treatment @ 1 mm Hg Abs.

greatest hydrogen removal using air ejectors was 1.5 ppm—with the least being 0.5 ppm.

The air ejector cycle nitrogen removal varied from a high of 20% to a low of 3% with an average removal value of 12%. The average nitrogen levels are shown in FIG. 6.

FIG. 7 illustrates an alternative embodiment in which an air ejector 14, as above described, or a mechanical pump with a compression ratio of about 5 to 1 is placed in the exhaust line down stream from a blower 19 of the Roots, vane, piston or screw type, or a water ring pump having a compression ratio of about 2 to 1. As a result, an absolute vacuum in the chamber 10 of about 75 mm Hg can be obtained. Proper filtration upstream of the pump is, of course, essential to preserve the life of the pump.

It will be noted that with high purging rates as described herein plus air ejector means placed in series, a low absolute pressure can be attained, and hence a great degree of hydrogen removal is made possible, all without the equipment and operating expense of steam jet ejectors.

Air ejectors are small and inexpensive and an excellent standby in case of steam failure. Two, 2" air ejectors and one, 3" air ejector were used for the trial heats described above.

| No. of Air Ejectors | Suction Inlet | Motive Inlet | Motive Fluid (Compressed Air) |
|---|---|---|---|
| 1 | 3" | 2" | 2050#/Hr. |
| 2 | 2" | 1¼" | 1025#/Hr. each |

The 2" air ejectors operated in parallel much like holders to pull down to 200 mm. At this vacuum level, the air supply was cut over to the 3" ejector to continue down to deeper vacuum of around 100 mm. Using this operational sequence, the motive fluid requirement was essentially constant at 2050#/Hr. (482 CFM) of 100 psig compressed air. The air was supplied by a 100 HP rotary screw compressor.

Air ejectors combined with arc and high purge rates are a means of processing heats as a stand-alone backup system in the event of a steam supply failure in a conventional steam ejector system. The air ejectors used for these trials can be backup for a conventional vacuum arc degassing system.

The maximum purge rate can be described as the maximum rate the available free board in the container can accommodate without boilover, and it will vary from installation to installation. In effect, it is believed that the equipment generated partial vacuum plus the high purge rate produces a hydrogen partial pressure which equals 1 mm Hg absolute.

The invention can be used as the sole means for achieving the disclosed advantages in Third World countries where a shortage of technical, maintenance, and operations staff exists. Short cycles will be possible if heating, deoxidation, and alloy additions are done simultaneously, thereby eliminating the need to go to 1 mm Hg absolute pressure. By using compressed air as the motive fluid, the complexity of the vacuum system is reduced dramatically. A number of items essential to a steam ejector system can be eliminated, including:

(1) Large ejectors, condensers, and piping
(2) Boiler and feed water treatment
(3) Large cooling tower. Using vacuum arc degassing costs as a reference, it is estimated that the herein disclosed system with air ejectors would be about 20% cheaper than a conventional vacuum arc degassing with a steam ejector system.

Another advantage is that the VAD tank and arcing systems remain unchanged in design. If a plant's product mix were to change and deep vacuum was required on all heats, the additional requirements could be easily accommodated. By proper layout of the described system, it will be a simple construction task to add a conventional steam ejector system.

Further, the system is usable in very cold climates, such as Alberta, where water in conventional steam ejector systems must be heated due to sub-freezing temperatures in the winter months.

Figure 8:
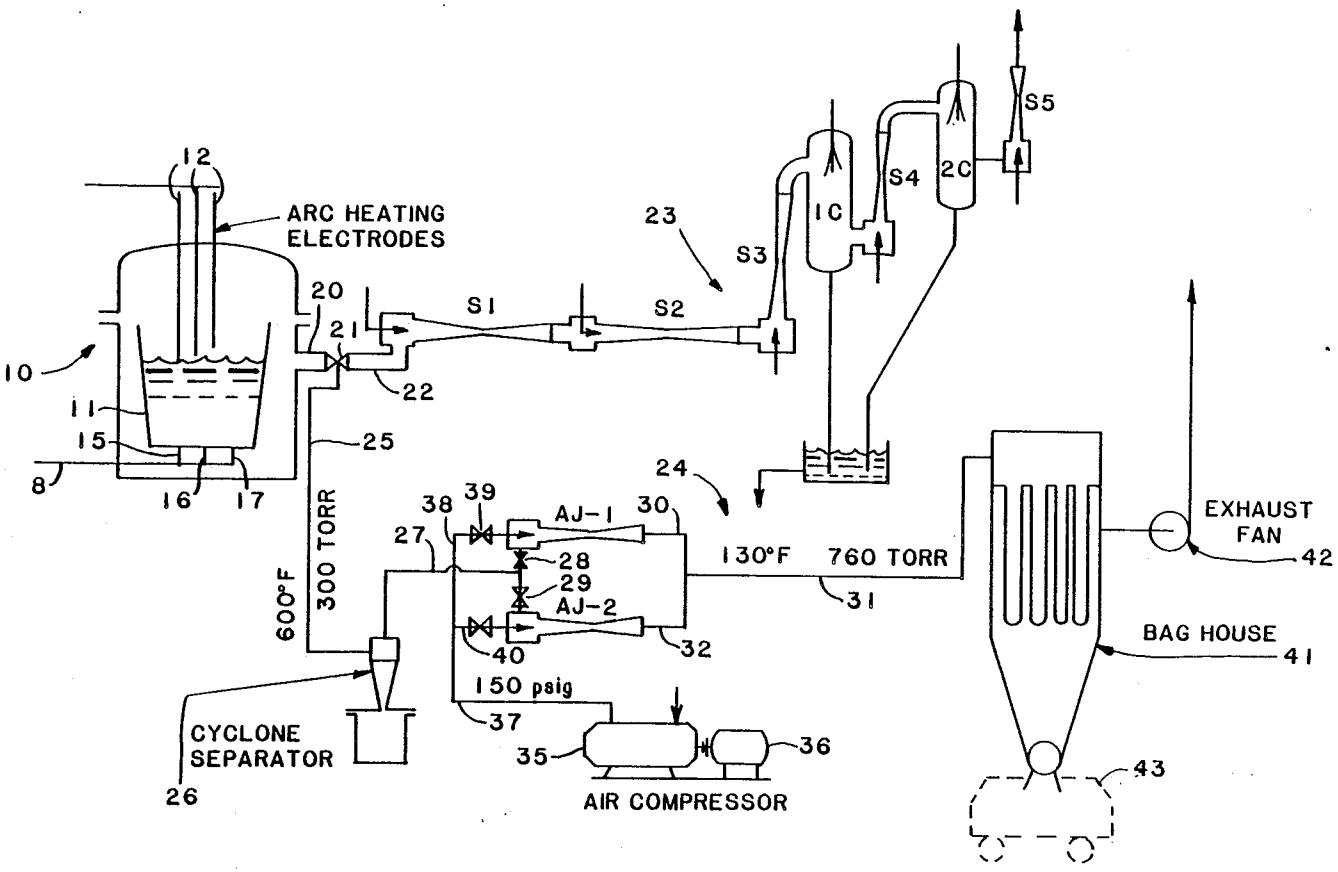
FIG. 8 is a diagrammatic sketch of another embodiment of the invention.

In the embodiment of FIG. 8 the vacuum tank and arc heating systems are identical to those illustrated in connection with the embodiments of FIGS. 1–7. In this system, however, the tank exhaust port 20 has a 2-Way (or 3-Way) shut-off valve 21 which functions to connect the interior of the tank 10 to either (a) downstream pipe 22 and thence to the multi-stage steam ejector system indicated generally at 23 and shut off communication with the air ejector cyclone separator-bag house system indicated generally at 24, or (b) by-pass pipe 25 and thence to the air ejector cyclone separator-bag house system 24 and shut off communication with the steam ejector system 23. It will be understood that both systems may be installed and operated in conjunction with a common vacuum chamber, and hence both are illustrated. The following description of the air ejector system should be read with the understanding that if a final, very low vacuum is required, as when flake-free steel for critical applications is desired, the steam ejector system may be used in conjunction with the air ejector system, or without assistance of the air ejector system. It is sufficient to note that the reference numerals S1–S5, inclusive, represent the five stages of the steam ejector system and 1C and 2C represent conventional condensers which discharge into a common dirty water system.

Referring now to the air ejector system, it will be seen that by-pass pipe 25 admits exhaust gases with entrained dust and dirt into a cyclone separator indicated generally at 26. In this connection, and for purposes of this specification, the term "dirt" will be used to mean solid particles, the great bulk of which are of larger than micron size, and the term "dust" will be used to mean solid particles the great bulk of which are micron size or smaller. It is believed that there is, as of today, no universally accepted definition of the non-gaseous components removed from the tank during operation, though it is believed the aforesaid definitions are reasonably descriptive and impart meaningful concepts to those skilled in the art.

A large portion, if not the bulk, of the dirt entrained in the exhaust gases from the tank are removed in the cyclone separator 26 and may be easily cleaned from time to time as operating conditions permit.

Line 27 connects the substantially dirt-free gases leaving the cyclone separator to air ejector AJ-1 via on-off admission valve 28, or to air ejector AJ-2 by on-off admission valve 29. Exit line 30 connects air ejector AJ-1 to baghouse line 31, and exit line 32 connects air ejector AJ-2 to baghouse line 31.

Air compressor 35, driven by motor 36, supplies compressed air (a) via line entry line 38 which is controlled by on-off valve **39*a*, to air ejector AJ-1**, or (*b*) to entry line 40, which is controlled by on-off valve 39b to air ejector AJ-2.

The cooled gases which exit the air ejectors enter baghouse 41 where the bulk of the remaining dust and, in all probability, some dirt is removed in a conventional manner. An exhaust fan which discharges to atmosphere is indicated at 42. The fan may be employed if there is not enough energy at this stage of the system to push the gases through the baghouse. The fan may, of course, be located upstream of the baghouse if more convenient in a particular installation. By placement downstream as shown, dirt and dust are removed before the gases reach the fan.

A typical operating cycle will be substantially as follows.

With shut-off valve 21 operated to isolate the steam ejector system 23, gases together with entrained dirt and dust will flow via line 25 to cyclone separator 26. A typical temperature of the gas entering the cyclone separator may be on the order of about 600° F. With admission valve 29 in the off position and admission valve 28 in the on position, the pressure in lines 25 and 27, and valve 28 may be on the order of about 300 Torr if AJ-1 has approximately a three inch suction inlet and a 2" motive inlet as described above. If, after reaching this absolute pressure level, AJ-1 is shut off, as by closure of valve 28, and AJ-2 is activated, as by the opening of valve 29, the pressure may be in the range of from about 75 Torr to 150 Torr as determined by the system parameters earlier described, but in any event, above the glow range.

In either event, the temperature in the baghouse inlet line will be on the order of about 130° F., and the pressure will be atmospheric.

In the baghouse the great bulk of the remaining dirt, if any, and dust will be separated from the gases in which they are entrained, and substantially dirt and dust free gases will be discharged to the atmosphere. The dirt and dust separated in the baghouse is cleaned out periodically by clean-out mechanism 43 which is well known in the art.

The advantages of the illustrated and described embodiment can be appreciated from the following.

All vacuum arc degassing systems have a common dirt and dust problem; that is, the dirt and dust leaving the vacuum chamber builds up in the ejector stages, and particularly the booster stages, and also accumulates in the heat wells, settling basins and other locations.

Drop out pockets and clean out doors have been installed to collect and remove the dirt and dust, but these expedients have yielded minimal results. High pressure water sprays, either manual or built-in have been used and are effective in removing the build-up in the throats of the ejectors, but these do not remedy the problem because the ejectors run at less than optimum efficiency prior to cleanout, and dirt and dust accumulates in other undesirable locations in the system. Dirt separators using metal turnings have been tried with some success but they are a nuisance to maintain. An expedient which would naturally occur to one skilled in the art would be to by pass the booster ejector stages and deliver the gases to one of the direct contact condensers or to a water ring pump. Such expedients would relieve the build-up in the booster ejectors but would not correct the build-up in the water systems. Some shops are very concerned due to local factors about dirt build-up in the water system and strive at all times to maintain the water system as clean as possible.

The possibility of directing the exhaust gases directly from the tank to a conventional baghouse operating under vacuum and then to the final stage of the vacuum system is not feasible because the acceptable working temperature of baghouses, as currently available on a commercial scale, are well below the temperature of the exhaust gases. For example, the maximum acceptable limit of baghouses is currently only about 225° F., and the temperature of the exhaust gases is on the order of about 600° F. Conventional means to cool the stream would require mixing tempering (i.e.: diluting) air with the hot exhaust gases to reduce the temperature to the baghouse temperature limitation. However, tempering air could not be used in the described system since the volume would require excessively large pumping capacities. Alternately, shell and tube heat exchangers could be used ahead of the baghouse, but the dirt and dust load remaining in the exhaust gases after leaving the cyclone separator would plug up the heat exchangers.

The described embodiment overcomes all of the above problems by installing the air ejector immediately after the vacuum tank and delivering the treated gas stream at its discharge temperature, i.e.: usually less than 225° F., but in any event within the temperature limitation of the baghouse, and atmospheric pressure directly to a conventional baghouse separator.

From test results on a 60 ton system using two air ejectors as above described, the following will be noted:

| | |
|---|---|
| Motive air = 225 scfm = | 450 scfm |
| pumped gas = | 200 scfm |
| TOTAL | 650 scfm |

Therefore, actual gas delivered at 130° F.=724 acfm This amount is a negligible increase in gas load compared to the capacity of the bag house of a conventional arc melting furnace.

The operating advantages of the described system include the elimination of build-up of dirt in the water systems, the use of a baghouse instead of a heat exchange condenser (a baghouse is inherently more efficient than a comparable heat exchange condenser), and great throughput capacity before clean up is required, this latter advantage being particularly important for high throughput shops. Further, the gases leaving the air ejector are dry.

A great advantage of the above described system in conjunction with steels which must be melted to a low sulfur content, such as 0.010 or below, is that such steels can be made with no excessive degradation of the steam ejector system. Low sulphur contents require final hydrogen contents of even lower than the normally accepted standard of 2.2 ppm, and, as is well known, the attainment of such low sulphur with flake-free properties is a difficult task for the steelmaker. However, the system illustrated in FIG. 8 provides the ideal combination of operating parameters to achieve the desired result. Specifically, the air ejector system 24 of FIG. 8 would not be activated until the bulk of the dirt and dust has been removed. Once this point is reached, the air ejector system is switched off by operation of valve 21, and the steam ejector system 23 activated to subject the steel to the very low vacuum required. As a result, little or no dirt or dust will collect in the steam ejector. The operation of the system is advantageous from the practical standpoint as well. As is well known, the inside of a vacuum tank in a vacuum arc degassing system is initially cloudy and visual inspection is of little benefit. However, as soon as the atmosphere becomes too rare to support the dirt, the atmosphere clears and the operator then immediately knows that operation of the steam ejector system can commence without build-up of dust in said system.

The economic advantage of the described system, even assuming a bag house must be purchased, over the best alternatives which can be visualized (i.e.: a water ring and separator pump operating in conjunction with an exchange heat condenser) is on the order of about $44,000 (compressor -$30,000; air ejectors (2) - $4,000; baghouse - $10,000) vs. $80,000 (water ring pump - $60,000; exchange heat condenser - $20,000).

In a further embodiment utilizing the air ejector system illustrated in FIG. 8, a super high purge rate in the tank is used in conjunction with the air ejector system, but without arc heating or the steam ejector system.

Specifically, a sealed chamber is employed as above-described in connection with the embodiments of FIGS. 1–7 and FIG. 8, but arcs 12 and the entire steam ejector system of FIG. 8 may be eliminated or inactivated. The molten steel is subjected to a super high inert gas purge rate of about 10 scfm for each purging gas admission location, and the air ejector system is operated to create the intermediate vacuum in the vacuum chamber. Preferably, and using a 60 short ton heat in a conventional ladle as a reference point, the rate of gas purge should be substantially as follows: one admission location for up to about 50 tons; two gas admission locations for from about 50 tons up to about 150 tons; and three gas admission locations for heats of about 150 tons or more. Those skilled in the art will recognize the above described purging rates as extremely high. One inevitable result will be a very high boil. In a single gas emission location it is contemplated that such a high purge rate used in conjunction with the air ejector system of this invention will require on the order of about one meter of freeboard, and a system using two or more gas admission locations will require about 1½ meters of freeboard. The freeboard, and not the temperature drop, will be the limiting factor of the process since the results derived, especially if non-flake-free steel is required, will be accomplished quickly enough so that deleterious superheat is not required. The violent boil also speeds up the slag-metal reactions and, further, shortens the cycle time. For low alloy steel this can mean a tapping temperature of anywhere in the 2,850° F. to 2,950° F. range.

Figure 9:
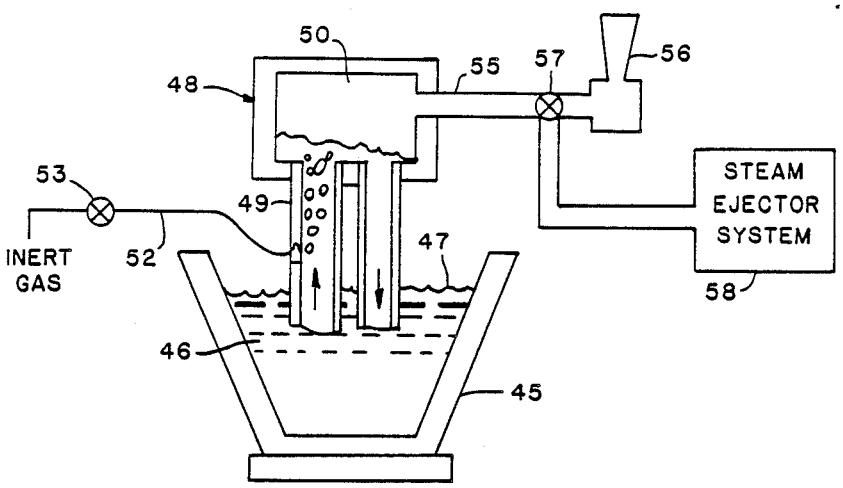
FIG. 9 is a diagrammatic sketch of another embodiment of the invention, this time as applied to the DH process.

FIG. 9 illustrates the invention as applied to the RH system. A stationary holding or source vessel is indicated at 45 which holds a heat of molten steel 46 whose upper surface 47 is exposed to ambient atmosphere. A suitable slag may, of course, be present on the surface of the steel. An elevated treatment chamber vessel is indicated generally at 48. Vessel 48 has a refractory lined conduit, or first leg, indicated at 49, up which molten steel is drawn when a sub-atmospheric pressure is applied to the interior 50 of treatment vessel 48. A gas porous plug (or, if desired, a pipe or tuyere) is shown at 51 connected by line 52 to a regulating and shut off valve 53 which controls the flow of a purging gas which is inert or at least non-deleterious with respect to the composition undergoing treatment. Argon is often used. Vessel 48 also includes a second refractory lined conduit, or second let, 54 down which molten steel returns to source vessel 45 following treatment in the treatment chamber 48.

Treatment chamber 48 has an off-take 55 which leads to either only an air ejector, indicated at 56 or, alternatively, to an off-on-diverter valve 57 which connects off-take 55 to either air ejector 56 or a steam ejector system 57.

Since the air ejector 56 can be of the same general design as the air ejector earlier described, and assuming a similar size of heat 46, a sub-atmospheric pressure of about 150 mm Hg to 50 mm Hg can be created in the treatment chamber vessel using air ejector 56 only. This vacuum level when applied in conjunction with inert gas admitted to up leg 49 at a rate now well known in the art will set up an excellent circulation of molten steel between the two vessels via legs 49 and 54. Application of a vacuum of this magnitude can be applied for an initial period of time which will be sufficient to eliminate the great bulk of the dust and much of the dirt, the exact length of time depending, of course, on the conditions described above. Processing can terminate at this time or, optionally, diverter valve 57 may be operated to close off air ejector 56 and cut in steam ejector 57 if, for example, very low H is desired.

Figure 10:
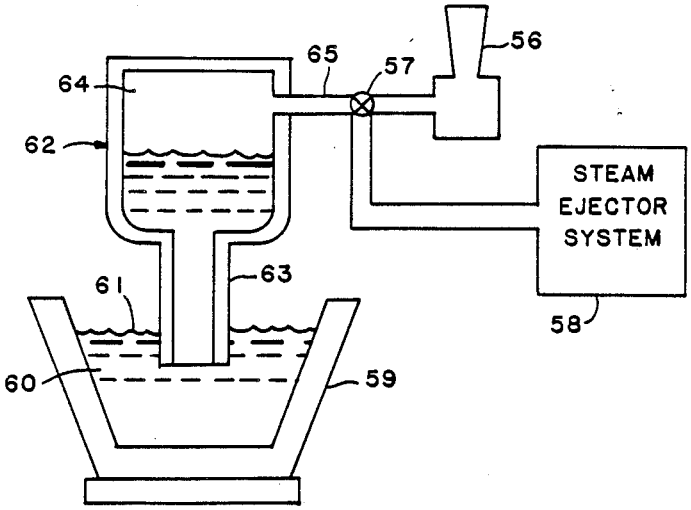
FIG. 10 is a diagrammatic sketch of another embodiment of the invention as applied to the RH process.

FIG. 10 illustrates the invention as applied to the DH system. A stationary holding or source vessel is indicated at 59 which holds a heat of molten steel 60 whose upper surface 61 is exposed to ambient atmosphere. A suitable slag may, of course, be present on the steel. An elevated treatment chamber vessel is indicated generally at 62. Vessel 62 has a single refractory lined conduit 63 up which molten steel 60 is drawn when a sub-atmospheric pressure is applied to the interior 64 of the treatment vessel 62 and the position of stationary holding vessel 59 and treatment vessel 62 are changed in a manner well known in the art.

Treatment chamber 62 has an off-take 65 which leads to either only an air ejector, indicated at 56, or, alternatively, to an off-on-diverter valve 57 which connects off-take 65 to either air ejector 56 or a steam ejector system 57.

Since the air ejector 56 can be of the same general design as the air ejector earlier described, and assuming a similar size of heat 60, a sub-atmospheric pressure of about 150 mm Hg to 50 mm Hg can be created in the treatment chamber using air ejector 56 only. This vacuum level when applied in conjunction with the reciprocating movement of the treatment vessel with respect to the stationary source vessel 59 will set up and down cyclical movement of molten steel between the two vessels. Application of a vacuum of the magnitude derivable from air ejector means as earlier described for an initial number of cycles will be sufficient to eliminate the great bulk of the dust and much of the dirt, the exact length of time depending, of course, on the conditions described above. Processing can terminate at this time or, optionally, diverter valve 57 may be operated to close off air ejector 56 and cut in steam ejector 57 if, for example, very low H is required.

From the above it will be seen that the air ejector system can (a) satisfactorily perform the great bulk of the heating, holding and degassing functions at lower cost than the current systems used in the art, such as the multi-station or multi-unit ladle furnace and ladle degasser combination, or the ASEA unit, (b) make existing steam ejector systems easier to operate, and (c) solve cleaning and sludge problems associated with wet systems. Indeed, the air ejector system can enhance the vacuum arc degassing system when used in conjunction therewith as by, for example, reducing clean out from weekly to, possibly yearly. In summary, the air ejector system of this application:

(1) solves the cleaning problem associated with ladle degassers, the ASEA system or, indeed, any steam ejector system in which a high purge rate can be satisfactorily substituted for a very low vacuum;

(2) functions as pre-cleaner for vacuum arc degassing systems, such as the DH and the RH systems;

(3) permits operation of vacuum processing plants in Arctic regions; and (4) provides an effective treating method in Third World locations where clean air and steam generation and handling are a problem.

A summary of the practical characteristics of the air ejector system includes the following:

(1) compressed air is employed thereby eliminating a boiler;

(2) it is a dry system and therefore the inevitable dust build up is easy to collect;

(3) a minimum vacuum level of about 50 mm Hg can be attained which is adequate for many applications;

(4) final 0 values can be on a par with a vacuum arc system or, indeed, any system using a deep vacuum;

(5) final H values may be only $\frac{1}{3}$ to $\frac{1}{2}$ ppm greater than a vacuum arc degassing or other deep vacuum system;

(6) very high purge rates are required;

(7) it is significantly less expensive than any of the existing conventional systems;

(8) the cost of fume control can be no greater than the cost of forming vacuum tight electrodes;

(9) It operates independently of ambient temperature thereby making operation in Arctic regions feasible; and (10)it is simpler to operate and maintain that existing systems.

Although a preferred embodiment and alternative embodiments of the invention have been illustrated and described, it will be apparent that modifications may be made within the spirit and scope of the invention. Accordingly, the scope of the invention should be limited solely by the scope of the hereinafter appended claims when interpreted in view of the pertinent prior art.

We claim:

1. In a method of decreasing the content of undesired gases in a batch of molten steel comprising the steps of isolating at least a portion of the batch of molten steel containing undesired gases from ambient atmosphere whereby a non-atmospheric region is established above at least said portion of the molten steel, passing a purging agent upwardly through at least said portion of the molten steel from a location beneath the surface of said portion which is exposed to the non-atmospheric region, diverting gases in the region above at least said portion of the molten steel to air ejector means at a rate sufficient to create a sub-atmospheric pressure in the non-atmospheric region above the molten steel, and discharging the gases drawn from said region, and additional gases which may be added to the air ejector means, from the air ejector means at a temperature which is within the temperature tolerance range of a baghouse.

2. In a system for treating a batch of molten steel, said system comprising structure which forms a non-atmospheric region above said batch of molten steel, means for admitting at least a portion of said batch of molten steel to the region above said batch of molten steel, means for intimately exposing the steel in said region to the existing gases composing the non-atmospheric region, air ejector means connected to the non-atmospheric region above the molten steel capable of diverting gases in said region and solids entrained in said gases to a discharge point, and means for removing solids entrained in said gases from said gases prior to discharge of said gases to the atmosphere.

3. The method of claim 1 further characterized in that the purging agent is passed upwardly through the molten steel at least partially during the time the gases in the region above the molten steel are diverted by said air ejector means.

4. The method of claim 1 further characterized in that the gases diverted from said region, together with solids entrained therein, are passed through a cyclone separator whereby a portion of the entrained solids are removed.

5. The method of claim 4 further characterized in that the gases diverted from the region above the molten steel are passed through the cyclone separator prior to their passage through the air ejector, means.

6. The method of claim 1 further characterized in that the gases discharged from the air ejector means are at a temperature no greater than about 225° and at a pressure which is substantially atmospheric.

7. The method of claim 1 further characterized in that the gases discharged from the air ejector means are passed through a baghouse whereby at least a portion of the solids entrained in said gases as said gases leave the air ejector means are removed in said baghouse.

8. The method of claim 7 further characterized in that a pressure differential across the baghouse is created by means in the flow path of the gases which is downstream from the air ejector means.

9. The method of claim 6 further characterized in that a pressure differential across the baghouse is created by means in the flow path of the gases which is downstream from the baghouse.

10. The method of claim 1 further characterized in that the molten steel is subjected to a heating arc.

11. The method of claim 10 further characterized in that the heating arc is derived from alternating current which is applied directly to the surface of the molten steel from electrode means.

12. The method of claim 10 further characterized in that the electrode means are selected from the group consisting essentially of three carbon-type electrodes or a single DC electrode.

13. The method of claim 1 further characterized in that the purging agent is passed upwardly through the molten steel during at least a portion of the time the gases in said region above the molten steel are diverted from said region by said air ejector means.

14. The method of claim 13 further characterized in that the rate of gas purge is no less than about 10 scfm per gas purge admission point.

15. The method of claim 14 further characterized in that the number of gas purge admission locations vary with the quantity of molten steel being treated in the ratios of one gas admission location for up to about 50 short tons of steel, two gas admission locations for from about 50 to about 150 short tons, and three gas admission points for over about 150 short tons.

16. In a system for treating a batch of molten steel, structure which forms a non-atmospheric region above at least a portion of said batch of molten steel, purging agent means located at a position beneath the upper surface of said portion of said molten steel, air ejector means connected to the non-atmospheric region above the molten steel capable of diverting gases in said region and solids entrained in said gases to a discharge point, and means for removing solids entrained in said gases from said gases prior to discharge of said gases to the atmosphere.

17. The system of claim 16 further characterized in that the purging agent means includes means for admitting a purging agent to the molten steel at the rate of no less than about 10 scfm per purging agent admission location.

18. The system of claim 17 further characterized in that the purging agent admission locations are provided on the basis of one location for up to about 50 short tons of molten steel, two admission locations for from about 50 to about 150 short tons, and three admission locations for over about 150 short tons of molten steel.

19. The system of claim 16 further characterized in that the air ejector means are arranged to discharge gases, and solids which may be entrained in said gases, at a temperature within the temperature tolerance range of a baghouse, and the means for removing solids entrained in said gases include a baghouse.

20. The system of claim 19 further characterized in that the means for removing solids entrained in said gases further includes a cyclone separator, said cyclone separator being located in the flow path of the gases at a location which is between the region of sub-atmospheric pressure above the molten steel and the air ejector means.

* * * * *

UNITED STATES PATENT AND TRADEMARK OFFICE

CERTIFICATE OF CORRECTION

PATENT NO. : 4,950,324

DATED : August 21, 1990

INVENTOR(S) : Charles W. Finkl, Bruce Liimatainen, Herbert S. Philbrick

It is certified that error appears in the above-identified patent and that said Letters Patent is hereby corrected as shown below:

The following text should appear after line 8 of column 1 and prior to the heading BACKGROUND OF THE INVENTION.

This invention relates to a new method for the post melting treatment of molten steel in all, or nearly all, of the post melting systems in use at this time to lower the oxygen, hydrogen, and, to some extent, the nitrogen content thereof, and carry out the other purposes for which such systems are used including temperature and chemical homogeni zation, continuous casting, piggy backing and other post melting treatment systems in use at this time in a manner which is less capital intensive, easier to operate and simpler in construction and operation than any of the basic systems, and apparatus therefor.

UNITED STATES PATENT AND TRADEMARK OFFICE

CERTIFICATE OF CORRECTION

PATENT NO. : 4,950,324

DATED : August 21, 1990

INVENTOR(S) : Charles W. Finkl, Bruce Liimatainen, Herbert S. Philbrick

It is certified that error appears in the above-indentified patent and that said Letters Patent is hereby corrected as shown below:

Col. 1, line 49: delete "contact"; insert --concast--.

Col. 1, line 64: delete "DH"; insert --RH--.

Col. 2, line 35: delete "O"; insert --$O_2$--.

Col. 2, line 37: delete "O"; insert --$O_2$--.

Col. 2, line 39: delete "H"; insert --$H_2$--.

Col. 2, line 49: delete "," after "systems"; insert --.--
delete "and (f) a large isolating valve is required."

Col. 2, line 61: delete "RH"; insert --DH--.

Signed and Sealed this

Twenty-first Day of June, 1994

Bruce Lehman

*Attest:*

BRUCE LEHMAN

*Attesting Officer*

*Commissioner of Patents and Trademarks*